US011482387B2

(12) United States Patent
Cai et al.

(10) Patent No.: US 11,482,387 B2
(45) Date of Patent: Oct. 25, 2022

(54) MEMBRANE CIRCUIT BOARD AND MANUFACTURING METHOD THEREOF

(71) Applicant: Primax Electronics Ltd., Taipei (TW)

(72) Inventors: Liu-Bing Cai, Taipei (TW); Li-Xiong Deng, Taipei (TW); Fu-Zhou Wei, Taipei (TW); Li-Qiang Chen, Taipei (TW); Xiao-Ping Wang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/031,662

(22) Filed: Sep. 24, 2020

(65) Prior Publication Data

US 2022/0068575 A1 Mar. 3, 2022

(30) Foreign Application Priority Data

Aug. 27, 2020 (CN) ..... 202010876186.2

(51) Int. Cl.
*H01H 13/06* (2006.01)
*H01H 13/703* (2006.01)
*H01H 13/705* (2006.01)

(52) U.S. Cl.
CPC ..... *H01H 13/06* (2013.01); *H01H 13/703* (2013.01); *H01H 13/705* (2013.01)

(58) Field of Classification Search
CPC .... H01H 13/06; H01H 13/703; H01H 13/705; H01H 13/7006; H01H 13/7013; H01H 13/702; H01H 13/704; H01H 13/7057; H01H 2227/004; H01H 2227/006; H01H 2227/024; H01H 2209/016; H01H 2209/046; H01H 2209/068; H01H 2205/004
USPC ..... 200/511, 512
See application file for complete search history.

(56) References Cited

U.S. PATENT DOCUMENTS 6,043,441 A * 3/2000 Hashida ..... H01H 13/702 200/512
7,297,887 B2 * 11/2007 Matsumoto ..... G06F 3/045 200/314
7,351,922 B2 * 4/2008 Tanabe ..... G06F 3/045 200/5 A
2011/0186414 A1 * 8/2011 Kim ..... H01H 1/10 200/512

* cited by examiner

*Primary Examiner* — Lheiren Mae A Caroc
(74) *Attorney, Agent, or Firm* — Kirton McConkie; Evan R. Witt

(57) ABSTRACT

A membrane circuit board includes a first film substrate, a second film substrate, an insulating spacer substrate and a waterproof structure. The first circuit layer is installed on the first film substrate. A second circuit layer is installed on the second film substrate. The insulating spacer substrate arranged between the first film substrate and the second film substrate. The first circuit layer is arranged between the first film substrate and the insulating spacer substrate. The second circuit layer is arranged between the second film substrate and the insulating spacer substrate. The waterproof structure includes a first welding layer and a second welding layer. The first welding layer is arranged between the first film substrate and the insulating spacer substrate. The second welding layer is arranged between the second film substrate and the insulating spacer substrate.

3 Claims, 4 Drawing Sheets

MEMBRANE CIRCUIT BOARD AND MANUFACTURING METHOD THEREOF

FIELD OF THE INVENTION

The present invention relates to an input device, and more particularly to a membrane circuit board for a keyboard device and a manufacturing method thereof.

BACKGROUND OF THE INVENTION

With the increasing development of science and technology, a variety of electronic devices are designed in views of convenience and user-friendliness. For helping the user well operate the electronic devices, the electronic devices are gradually developed in views of humanization. The common electronic devices include for example mouse devices, keyboard devices, trackball devices, or the like. Via the keyboard device, characters or symbols can be inputted into the computer system directly. As a consequence, most users and most manufacturers of input devices pay much attention to the development of keyboard devices.

The conventional keyboard device usually comprises a base plate, a membrane circuit board, plural scissors-type connecting elements, plural keycaps and plural elastic elements. The scissors-type connecting element is connected between the base plate and the corresponding keycap. Generally, the membrane circuit board comprises three film layers. From top to bottom, these film layers comprise an upper film layer, an insulating spacer layer and a lower film layer. According to the conventional production technology, circuit patterns are firstly printed on the upper film layer and the lower film layer and then the upper film layer, the insulating spacer layer and the lower film layer are combined together.

As known, the membrane circuit board is a very important part within the keyboard device. If the foreign liquid is introduced into the inner portion of the keyboard device, the membrane circuit board is possibly damaged. For solving this problem, the membrane circuit board is designed to meet the high-standard waterproof requirements. Conventionally, a waterproof glue is printed on a periphery region of the membrane circuit board to achieve the effect of sealing the periphery region and preventing moisture from entering the inner portion. However, the process of printing the waterproof glue increases the production cost and is detrimental to the environment.

Therefore, there is a need of providing an improved membrane circuit board and a manufacturing method of the membrane circuit board in order to overcome the above drawbacks.

SUMMARY OF THE INVENTION

An object of the present invention provides a membrane circuit board and a manufacturing method of the membrane circuit board. An ultrasonic heat melting device is used to form a waterproof structure on the membrane circuit board. Consequently, the production efficiency is effectively enhanced, and the production cost is reduced.

The other objects and advantages of the present invention will be understood from the disclosed technical features.

In accordance with an aspect of the present invention, a membrane circuit board is provided. The membrane circuit board includes a first film substrate, a second film substrate, an insulating spacer substrate and a waterproof structure. The first circuit layer is installed on the first film substrate.

The second film substrate is opposed to the first film substrate. A second circuit layer is installed on the second film substrate. The insulating spacer substrate arranged between the first film substrate and the second film substrate. The first circuit layer is arranged between the first film substrate and the insulating spacer substrate. The second circuit layer is arranged between the second film substrate and the insulating spacer substrate. The waterproof structure includes a first welding layer and a second welding layer. The first welding layer is arranged between the first film substrate and the insulating spacer substrate. The first welding layer is arranged around the first circuit layer. The second welding layer is arranged between the second film substrate and the insulating spacer substrate. The second welding layer is arranged around the second circuit layer.

In an embodiment, the first film substrate has a first positioning opening, the insulating spacer substrate has a second positioning opening, and the second film substrate has a third positioning opening. The first positioning opening, the second positioning opening and the third positioning opening are aligned with each other.

In an embodiment, the first welding layer includes a first welding part and a second welding part, and the second welding layer includes a third welding part and a fourth welding part. The first welding part is arranged around the first circuit layer and the second welding part. The second welding part is arranged around a region between the first positioning opening and the second positioning opening. The third welding part is arranged around the second circuit layer and the fourth welding part. The fourth welding part is arranged around a region between the second positioning opening and the third positioning opening.

In an embodiment, the first welding layer further includes a fifth welding part, and the second welding layer further includes a sixth welding part. The fifth welding part is arranged between the first circuit layer and the first welding part. The fifth welding part is arranged around the first circuit layer and the second welding part. The sixth welding part is arranged between the second circuit layer and the third welding part. The sixth welding part is arranged around the second circuit layer and the fourth welding part.

In an embodiment, after the first film substrate, the insulating spacer substrate and the second film substrate are subjected to an ultrasonic heat melting treatment by an ultrasonic heat melting device, the first welding layer is formed between the first film substrate and the insulating spacer substrate, and the second welding layer is formed between the second film substrate and the insulating spacer substrate.

In an embodiment, the membrane circuit board further includes an anti-slip structure. The anti-slip structure is installed on a surface of the first film substrate away from the insulating spacer substrate, or the anti-slip structure is installed on a surface of the second film substrate away from the insulating spacer substrate.

In accordance with another aspect of the present invention, a manufacturing method of a membrane circuit board is provided. The manufacturing method includes the following steps. Firstly, a first film substrate is provided. A first circuit layer is formed on the first film substrate. Then, an insulating spacer substrate is provided. Then, a second film substrate is provided. A second circuit layer is formed on the second film substrate. Then, an ultrasonic heat melting treatment is performed on the first film substrate, the insulating spacer substrate and the second film substrate. Consequently, a waterproof structure is formed. The waterproof structure includes a first welding layer and a second welding layer. The first welding layer is arranged between the first film substrate and the insulating spacer substrate. The second welding layer is arranged between the second film substrate and the insulating spacer substrate. The first welding layer is arranged around the first circuit layer, and the second welding layer is arranged around the second circuit layer.

In an embodiment, the insulating spacer substrate and the second film substrate, the manufacturing method further includes the following steps before the ultrasonic heat melting treatment is performed on the first film substrate. Firstly, a positioning treatment is performed on the first film substrate, the insulating spacer substrate and the second film substrate. Secondly, a correcting treatment is performed on the first film substrate, the insulating spacer substrate and the second film substrate.

In an embodiment, the positioning treatment, the correcting treatment and the ultrasonic heat melting treatment are performed in an ultrasonic heat melting device.

In an embodiment, the ultrasonic heat melting device includes a first roller device, a correcting device and a second roller device. The positioning treatment is performed on the first film substrate, the insulating spacer substrate and the second film substrate by the first roller device. The correcting treatment is performed on the first film substrate, the insulating spacer substrate and the second film substrate by the correcting device. The ultrasonic heat melting treatment is performed on the first film substrate, the insulating spacer substrate and the second film substrate by the second roller device.

From the above descriptions, the present invention provides a membrane circuit board and a manufacturing method of the membrane circuit board. After a first film substrate, an insulating spacer substrate and a second film substrate of the membrane circuit board are subjected to an ultrasonic heat melting treatment, the first film substrate, the insulating spacer substrate and the second film substrate are combined as a waterproof structure. That is, a first welding layer is formed between the first film substrate and the insulating spacer substrate and arranged around the first circuit layer, and the second welding layer is formed between the second film substrate and the insulating spacer substrate and arranged around the second circuit layer. The first circuit layer and the second welding layer have the function of sealing the membrane circuit board while effectively preventing moisture from entering the internal circuit layers of the membrane circuit board through the space between the film substrates. The manufacturing method of the present invention can produce the membrane circuit board at the increased production efficiency and the reduced production cost. Since the waterproof glue is not used, the manufacturing method of the present invention is environmentally friendly.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
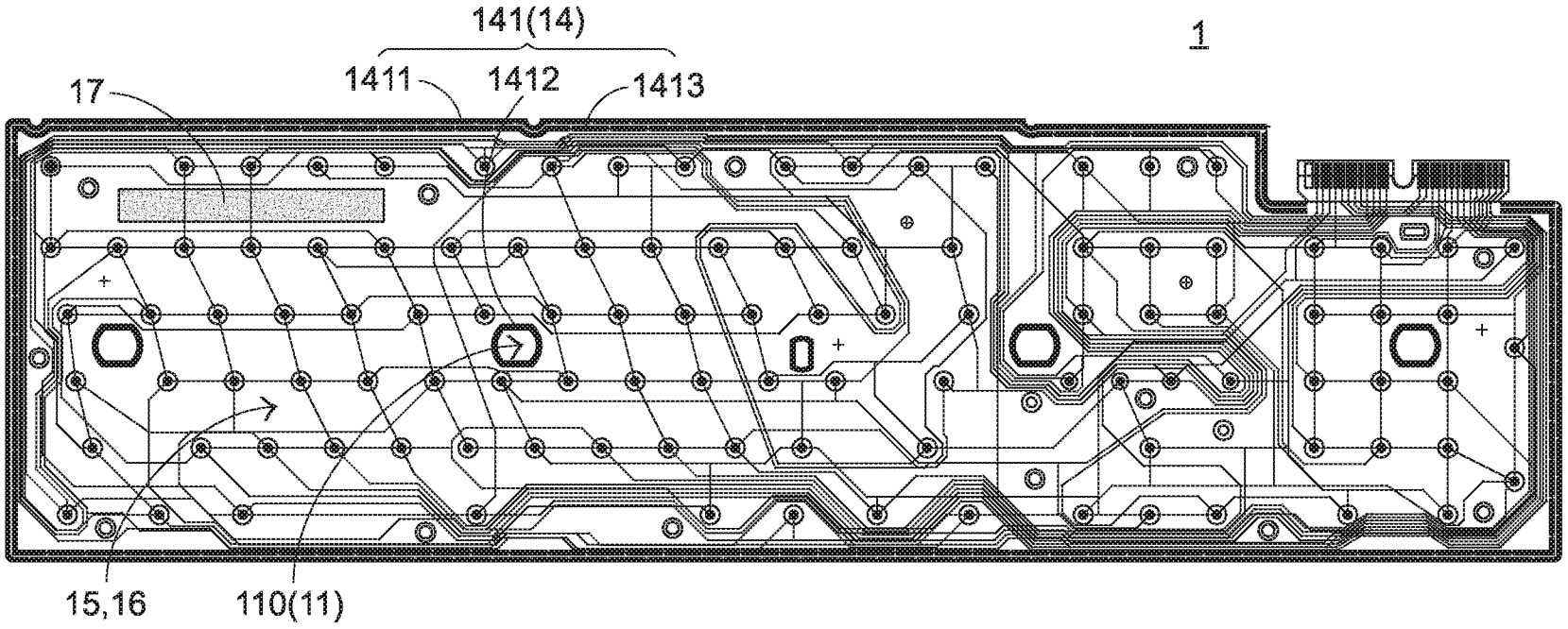
FIG. 1 schematically illustrates the structure of a membrane circuit board according to an embodiment of the present invention.
Figure 2:
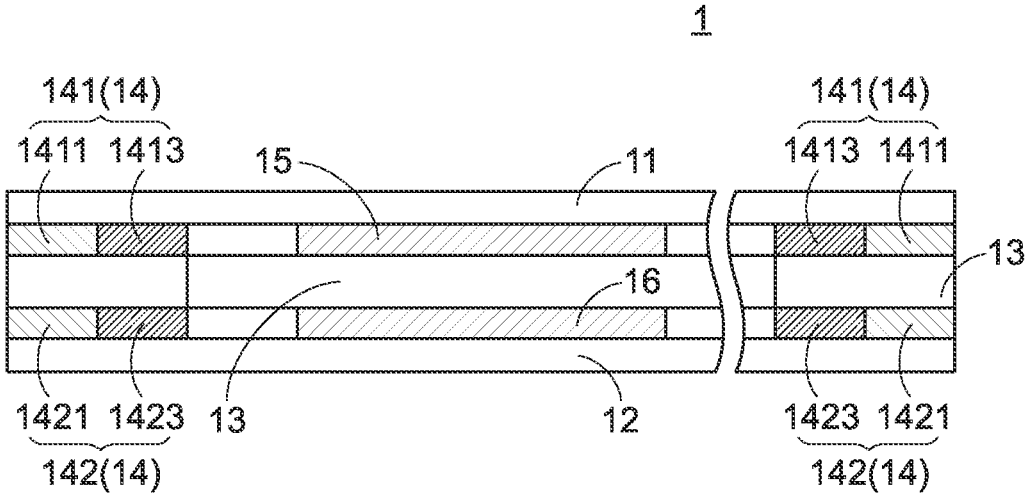
FIG. 2 is a schematic cross-sectional view illustrating a portion of the membrane circuit board as shown in FIG. 1 and taken along a viewpoint.
Figure 3:
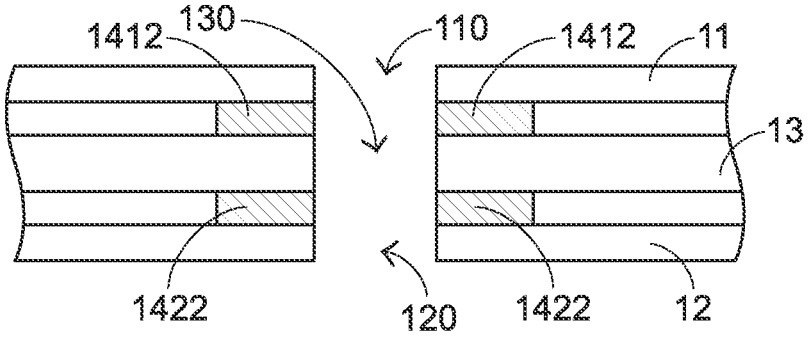
FIG. 3 is a schematic cross-sectional view illustrating a portion of the membrane circuit board as shown in FIG. 1 and taken along another viewpoint.

Please refer to FIGS. 1, 2 and 3. FIG. 1 schematically illustrates the structure of a membrane circuit board according to an embodiment of the present invention. FIG. 2 is a schematic cross-sectional view illustrating a portion of the membrane circuit board as shown in FIG. 1 and taken along a viewpoint. FIG. 3 is a schematic cross-sectional view illustrating a portion of the membrane circuit board as shown in FIG. 1 and taken along another viewpoint. As shown in FIGS. 1, 2 and 3, the membrane circuit board 1 comprises a first film substrate 11, a second film substrate 12, an insulating spacer substrate 13 and a waterproof structure 14.

A first circuit layer 15 is installed on the first film substrate 11. The first film substrate 11 and the second film substrate 12 are opposed to each other. A second circuit layer 16 is installed on the second film substrate 12. The insulating spacer substrate 13 is arranged between the first film substrate 11 and the second film substrate 12. The first circuit layer 15 is arranged between the first film substrate 11 and the insulating spacer substrate 13. The second circuit layer 16 is arranged between the second film substrate 12 and the insulating spacer substrate 13. The waterproof structure 14 comprises a first welding layer 141 and a second welding layer 142. The first welding layer 141 is arranged between the first film substrate 11 and the insulating spacer substrate 13. Moreover, the first welding layer 141 is arranged around the first circuit layer 15. The second welding layer 142 is arranged between the second film substrate 12 and the insulating spacer substrate 13. Moreover, the second welding layer 142 is arranged around the second circuit layer 16.

Preferably but not exclusively, the first film substrate 11 and the second film substrate 12 are polyester (PET) film substrates. Preferably but not exclusively, the first circuit layer 15 and the second circuit layer 16 are respectively printed on the surfaces of the first film substrate 11 and the second film substrate 12 according to the designated circuit patterns. The membrane circuit board 1 is installed on an external keyboard of a desktop computer (e.g., a keyboard with a PS2 interface or a keyboard with a USB interface) or a built-in keyboard of a notebook computer or a laptop computer. The applications of the membrane circuit board 1 are not restricted. That is, the concepts of the membrane circuit board 1 can be applied to any appropriate electronic product that uses the membrane circuit board 1 as the signal input interface.

The other detailed structure of the membrane circuit board will be described as follows.

Please refer to FIGS. 1, 2 and 3 again. The first film substrate 11 has at least one first positioning opening 110. The insulating spacer substrate 13 has at least one second positioning opening 130. The second film substrate 12 has at least one third positioning opening 120. The first positioning opening 110, the second positioning opening 130 and the third positioning opening 120 are aligned with each other. In this embodiment, the membrane circuit board 1 has plural first positioning openings 110, plural second positioning openings 130 and plural third positioning openings 120. It is noted that the number of these positioning openings is not restricted. When the membrane circuit board 1 is installed on the keyboard device, the membrane circuit board 1 assembled with and positioned in the casing of the keyboard device through these positioning openings.

Please refer to FIGS. 1, 2 and 3 again. The first welding layer 141 comprises a first welding part 1411 and a second welding part 1412. The first welding part 1411 is arranged around the first circuit layer 15 and the second welding part 1412. That is, the first welding part 1411 is located at the outermost region of the membrane circuit board 1 for sealing the gap between the first film substrate 11 and the insulating spacer substrate 13. Consequently, the moisture is not transferred to the first circuit layer 15 through the gap between the first film substrate 11 and the insulating spacer substrate 13. The second welding part 1412 is arranged around the region between the first positioning opening 110 and the second positioning opening 130. The second welding part 1412 is used for sealing the gap between the periphery of the first positioning opening 110 and the periphery of the second positioning opening 130. Consequently, the moisture is not transferred to the first circuit layer 15 through the first positioning opening 110 and the second positioning opening 130.

Please refer to FIGS. 1, 2 and 3 again. The second welding layer 142 comprises a third welding part 1421 and a fourth welding part 1422. The third welding part 1421 is arranged around the second circuit layer 16 and the fourth welding part 1422. That is, the third welding part 1421 is located at the outermost region of the membrane circuit board 1 for sealing the gap between the second film substrate 12 and the insulating spacer substrate 13. Consequently, the moisture is not transferred to the second circuit layer 16 through the gap between the second film substrate 12 and the insulating spacer substrate 13. The fourth welding part 1422 is arranged around the region between the second positioning opening 130 and the third positioning opening 120. The fourth welding part 1422 is used for sealing the gap between the periphery of the second positioning opening 130 and the periphery of the third positioning opening 120. Consequently, the moisture is not transferred to the second circuit layer 16 through the second positioning opening 130 and the third positioning opening 120.

As shown in FIGS. 1 and 2, the first welding layer 141 further comprises a fifth welding part 1413, and the second welding layer 142 further comprises a sixth welding part 1423. The fifth welding part 1413 is arranged between the first circuit layer 15 and the first welding part 1411. The fifth welding part 1413 is arranged around the first circuit layer 15 and the second welding part 1412. The sixth welding part 1423 is arranged between the second circuit layer 16 and the third welding part 1421. The sixth welding part 1423 is arranged around the second circuit layer 16 and the fourth welding part 1422. The fifth welding part 1413 cooperates with the first welding part 1411 to enhance the sealing strength between the first film substrate 11 and the insulating spacer substrate 13. The sixth welding part 1423 cooperates with the third welding part 1421 to enhance the sealing strength between the second film substrate 12 and the insulating spacer substrate 13. It is noted that numerous modifications and alterations may be made while retaining the teachings of the invention. For example, in another embodiment, the fifth welding part 1413 and the sixth welding part 1423 are omitted. Alternatively, at least two welding parts are arranged between the first film substrate 11 and the insulating spacer substrate 13 and between the second film substrate 12 and the insulating spacer substrate 13.

The following aspects should be specially described. After the first film substrate 11, the insulating spacer substrate 13 and the second film substrate 12 are subjected to an ultrasonic heat melting treatment, the waterproof structure is produced. That is, the first welding layer 141 is formed between the first film substrate 11 and the insulating spacer substrate 13, and the second welding layer 142 is formed between the second film substrate 12 and the insulating spacer substrate 13. The operating principles of the ultrasonic heat melting treatment will be described as follows. Firstly, a sound generator generates a high-frequency signal. Then, a welding head fixed on the ultrasonic heat melting treatment is directly contacted with a plate workpiece made of plastic material (e.g., PET). The high-frequency vibration causes the molecules in the plate workpiece to undergo the violent friction and generate the local high temperature. When the temperature is higher than the melting point of the plastic material, the plastic material is molten. When the molten plastic material is cooled down, the molten plastic material is re-solidified and bonded together to achieve a welding effect. In an embodiment, the welding head of the ultrasonic heat melting treatment is a roller-shaped welding head.

As shown in FIG. 1, the membrane circuit board 1 further comprises an anti-slip structure 17. The anti-slip structure 17 is installed on a surface of the first film substrate 11 away from the insulating spacer substrate 13 (i.e., the outer surface of the first film substrate 11 as shown in FIG. 2). While the first film substrate 11, the insulating spacer substrate 13 and the second film substrate 12 are subjected to the ultrasonic heat melting treatment by the ultrasonic heat melting device, the welding head of the ultrasonic heat melting device is rolled on the outer surface of the first film substrate 11. Due to the anti-slip structure 17, the friction between the first film substrate 11 and the roller-shaped welding head is increased. Consequently, the roller-shaped welding head is not in the idle state. It is noted that the installation position of the anti-slip structure 17 is not restricted to the outer surface of the first film substrate 11. In another embodiment, the anti-slip structure 17 is installed on a surface of the second film substrate 12 away from the insulating spacer substrate 13 (i.e., the outer surface of the second film substrate 12 as shown in FIG. 2). During the ultrasonic heat melting treatment, the welding head of the ultrasonic heat melting device is rolled on the outer surface of the second film substrate 12.

A method of manufacturing a membrane circuit board of the present invention will be described as follows.

Figure 4:
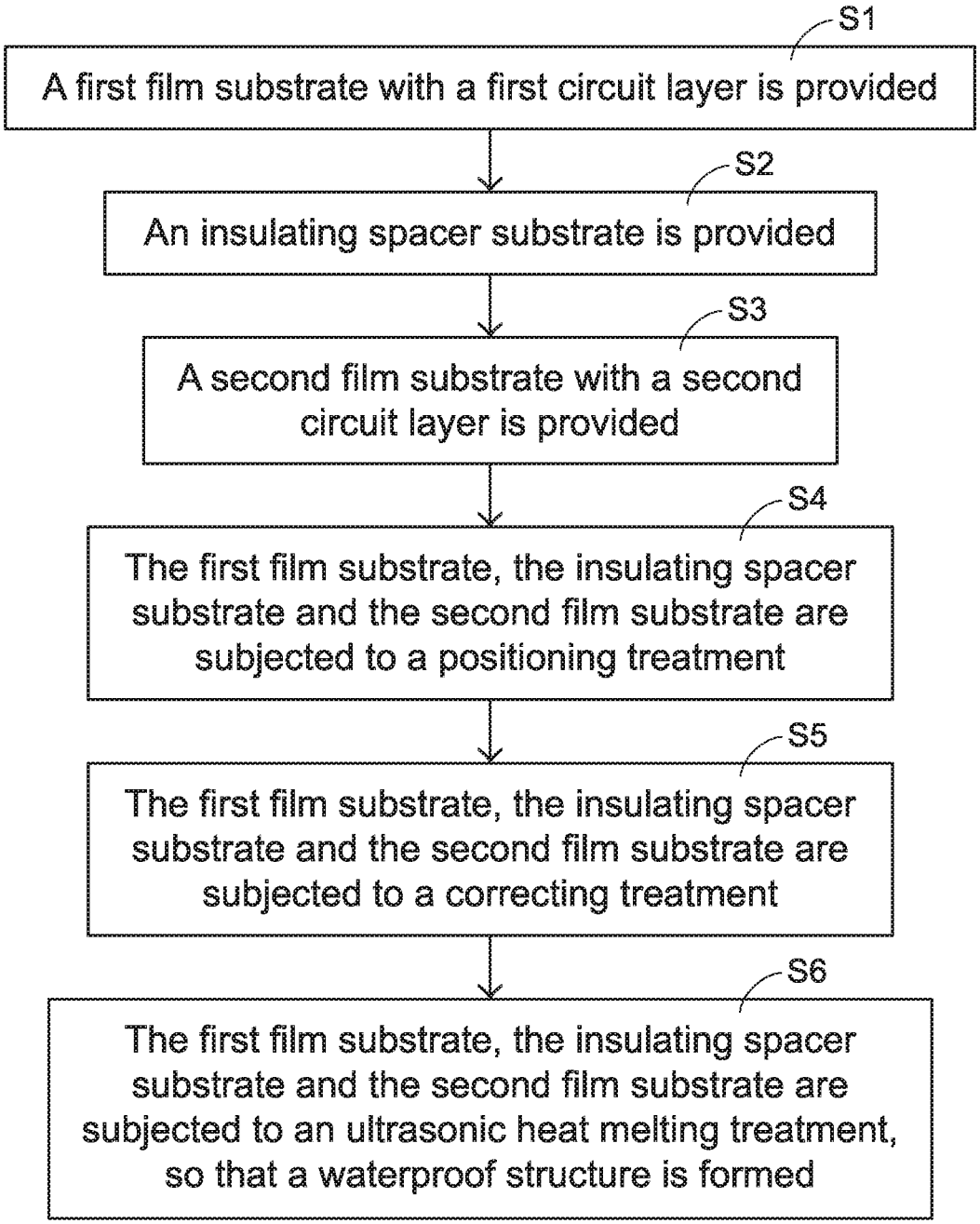
FIG. 4 is a flowchart illustrating a method of manufacturing a membrane circuit board according to an embodiment of the present invention.

FIG. 4 is a flowchart illustrating a method of manufacturing a membrane circuit board according to an embodiment of the present invention. Hereinafter, the manufacturing method will be described with reference to FIGS. 1, 2, 3 and 4. The manufacturing method comprises the following steps.

Firstly, in a step S1, a first film substrate 11 is provided. A first circuit layer 15 is formed on the first film substrate 11.

In a step S2, an insulating spacer substrate 13 is provided.

In a step S3, a second film substrate 12 is provided. A second circuit layer 16 is formed on the second film substrate 12.

In a step S4, the first film substrate 11, the insulating spacer substrate 13 and the second film substrate 12 are subjected to an initial positioning treatment. Consequently, the first film substrate 11, the insulating spacer substrate 13 and the second film substrate 12 are initially aligned with each other.

In a step S5, the first film substrate 11, the insulating spacer substrate 13 and the second film substrate 12 are subjected to a correcting treatment. Consequently, the relative positions between the first film substrate 11, the insulating spacer substrate 13 and the second film substrate 12 are finely tuned, and the alignment between these components is more precise.

In a step S6, the first film substrate 11, the insulating spacer substrate 13 and the second film substrate 12 are subjected to an ultrasonic heat melting treatment. Consequently, a waterproof structure 14 is formed. The waterproof structure 14 comprises a first welding layer 141 and a second welding layer 142. The first welding layer 141 is arranged between the first film substrate 11 and the insulating spacer substrate 13. The second welding layer 142 is arranged between the second film substrate 12 and the insulating spacer substrate 13. Moreover, the first welding layer 141 is arranged around the first circuit layer 15, and the second welding layer 142 is arranged around the second circuit layer 16.

Figure 5:
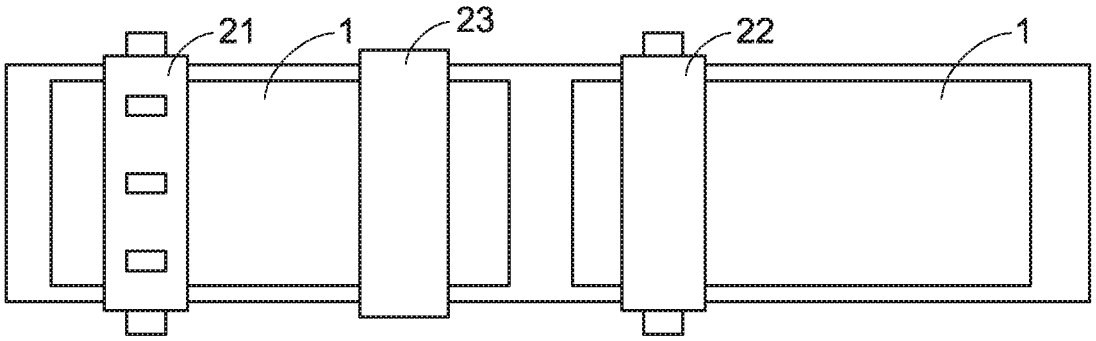
FIG. 5 schematically illustrates an ultrasonic heat melting device according to an embodiment of the present invention.

FIG. 5 schematically illustrates an ultrasonic heat melting device according to an embodiment of the present invention. The ultrasonic heat melting device 2 of FIG. 5 is applied to the manufacturing method of FIG. 2. The ultrasonic heat melting device 2 comprises a first roller device 21, a second roller device 22 and a correcting device 23. In the step S4 of FIG. 4, the positioning treatment is performed on the first film substrate 11, the insulating spacer substrate 13 and the second film substrate 12 by the first roller device 21. In the step S5 of FIG. 4, the correcting treatment is performed on the first film substrate 11, the insulating spacer substrate 13 and the second film substrate 12 by the correcting device 23. In the step S6 of FIG. 4, the ultrasonic heat melting treatment is performed on the first film substrate 11, the insulating spacer substrate 13 and the second film substrate 12 by the second roller device 22.

Figure 6:
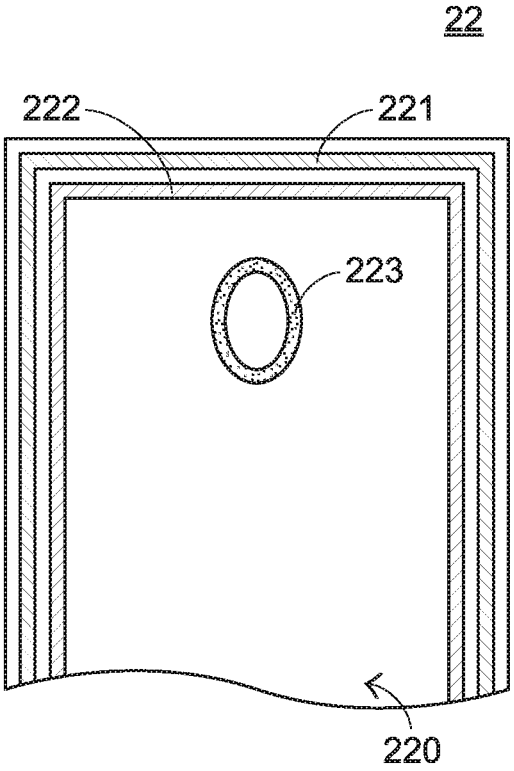
FIG. 6 schematically illustrates a portion of the second roller device of the ultrasonic heat melting device as shown in FIG. 5.

FIG. 6 schematically illustrates a portion of the second roller device of the ultrasonic heat melting device as shown in FIG. 5. As shown in FIG. 6, the second roller device 22 of the ultrasonic heat melting device 2 comprises a first pattern 221, a second pattern 222 and a third pattern 223. The first pattern 221, the second pattern 222 and the third pattern 223 are protruded from a surface 220 of the second roller device 22. When the ultrasonic heat melting device 2 performs the ultrasonic heat melting treatment on the first film substrate 11, the insulating spacer substrate 13 and the second film substrate 12, the first pattern 221, the second pattern 222 and the third pattern 223 are imprinted on the corresponding positions of the membrane circuit board 1. Consequently, the first welding part 1411, the second welding part 1412, the third welding part 1421, the fourth welding part 1422, the fifth welding part 1413 and the sixth welding part 1423 as shown in FIGS. 1, 2 and 3 are formed. In particular, the first welding part 1411 and the third welding part 1421 are formed through the first pattern 221, the fifth welding part 1413 and the sixth welding part 1423 are formed through the second pattern 222, and the second welding part 1412 and the fourth welding part 1422 are formed through the third pattern 223.

From the above descriptions, the present invention provides a membrane circuit board and a manufacturing method of the membrane circuit board. After a first film substrate, an insulating spacer substrate and a second film substrate of the membrane circuit board are subjected to an ultrasonic heat melting treatment, the first film substrate, the insulating spacer substrate and the second film substrate are combined as a waterproof structure. That is, a first welding layer is formed between the first film substrate and the insulating spacer substrate and arranged around the first circuit layer, and the second welding layer is formed between the second film substrate and the insulating spacer substrate and arranged around the second circuit layer. The first circuit layer and the second welding layer have the function of sealing the membrane circuit board while effectively preventing moisture from entering the internal circuit layers of the membrane circuit board through the space between the film substrates. The manufacturing method of the present invention can produce the membrane circuit board at the increased production efficiency and the reduced production cost. Since the waterproof glue is not used, the manufacturing method of the present invention is environmentally friendly.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A membrane circuit board, comprising:

a first film substrate, wherein a first circuit layer is installed on the first film substrate;

a second film substrate opposed to the first film substrate, wherein a second circuit layer is installed on the second film substrate;

an insulating spacer substrate arranged between the first film substrate and the second film substrate, wherein the first circuit layer is arranged between the first film substrate and the insulating spacer substrate, and the second circuit layer is arranged between the second film substrate and the insulating spacer substrate; and a waterproof structure comprising a first welding layer and a second welding layer, wherein the first welding layer is arranged between the first film substrate and the insulating spacer substrate, and the first welding layer is arranged around the first circuit layer, wherein the second welding layer is arranged between the second film substrate and the insulating spacer substrate, and the second welding layer is arranged around the second circuit layer, wherein the first film substrate has a first positioning opening, the insulating spacer substrate has a second positioning opening, and the second film substrate has a third positioning opening, wherein the first positioning opening, the second positioning opening and the third positioning opening are aligned with each other, wherein the first welding layer comprises a first welding part and a second welding part, and the second welding layer comprises a third welding part and a fourth welding part, wherein the first welding part is arranged around the first circuit layer and the second welding part, and the second welding part is arranged around a region between the first positioning opening and the second positioning opening, wherein the third welding part is arranged around the second circuit layer and the fourth welding part, and the fourth welding part is arranged around a region between the second positioning opening and the third positioning opening, wherein the first welding layer further comprises a fifth welding part, and the second welding layer further comprises a sixth welding part, wherein the fifth welding part is arranged between the first circuit layer and the first welding part, the fifth welding part is arranged around the first circuit layer and the second welding part, the sixth welding part is arranged between the second circuit layer and the third welding part, and the sixth welding part is arranged around the second circuit layer and the fourth welding part.

2. The membrane circuit board according to claim 1, wherein after the first film substrate, the insulating spacer substrate and the second film substrate are subjected to an ultrasonic heat melting treatment by an ultrasonic heat melting device, the first welding layer is formed between the first film substrate and the insulating spacer substrate, and the second welding layer is formed between the second film substrate and the insulating spacer substrate.

3. The membrane circuit board according to claim 1, further comprising an anti-slip structure, wherein the anti-slip structure is installed on a surface of the first film substrate away from the insulating spacer substrate, or the anti-slip structure is installed on a surface of the second film substrate away from the insulating spacer substrate.

* * * * *